US006800190B1

(12) United States Patent
Wilcox et al.

(10) Patent No.: US 6,800,190 B1
(45) Date of Patent: Oct. 5, 2004

(54) METHOD TO OBTAIN A VARIETY OF SURFACE COLORS BY ELECTROPLATING ZINC NICKEL AND NICKEL ALLOY OXIDES

(76) Inventors: Steven F. Wilcox, 606 W. Cummins St., Apartment No. 5, Tecumseh, MI (US) 49286; Fred T. Wilcox, 313 S. Pontiac Trail, Walled Lake, MI (US) 48390

( * ) Notice: Subject to any disclaimer, the term of this patent is extended or adjusted under 35 U.S.C. 154(b) by 0 days.

(21) Appl. No.: 09/859,003

(22) Filed: May 16, 2001

Related U.S. Application Data

(60) Provisional application No. 60/204,412, filed on May 16, 2000.

(51) Int. Cl.[7] ..... C25D 11/00
(52) U.S. Cl. ..... 205/333
(58) Field of Search ..... 205/246, 259, 205/333

(56) References Cited

U.S. PATENT DOCUMENTS 2,844,530 A * 7/1958 Wesley et al. ..... 204/40
6,391,181 B1 * 5/2002 Gorodetski et al. ..... 205/181

FOREIGN PATENT DOCUMENTS

JP 60-102629 A * 6/1985
JP 6-330373 A * 11/1994

OTHER PUBLICATIONS

Black Nickel, www.guildplaters.com, p. 1.*

* cited by examiner

*Primary Examiner*—Edna Wong
(74) *Attorney, Agent, or Firm*—James M. Deimen

(57) ABSTRACT

Disclosed are aqueous compositions and methods to produce durable and vitreous colored interference films of nickel zinc oxide electroplating, including white zinc metallic colored electrodepositions for the zinc embodiment; brass, bronze, burgundy, purple, blue, green and black electroplatings covering both high and low bath concentration embodiments. The films are useful for decorative and functional purposes. The distinguishing features of the coating are its vivid colorfulness, its specular reflection and the perception of binocular depth by the observer caused by translucence of the deposited film. The baths can coat a variety of metal substrates, including brass, copper and most ferrous metals. The alkaline plating bath embodiment of this invention permits the coating to be directly electroplated over zinc, as well as aluminum.

6 Claims, No Drawings

METHOD TO OBTAIN A VARIETY OF SURFACE COLORS BY ELECTROPLATING ZINC NICKEL AND NICKEL ALLOY OXIDES

This application claims the benefit of Provisional Application No. 60/204,412, filed May 16, 2000.

FIELD OF THE INVENTION

The field of invention pertains to coating electroconductive articles to produce colors thereon with a sense of depth and beauty for decorative purposes. In particular, the invention relates to electroplating of such coatings having decorative and functional utility for deposition on numerous electroconductive substrates.

There exists a need for a relatively inexpensive means of plating articles to provide vivid spectral interference thicknesses with greater coverage consistency and reproducibility than exist in the prior art.

BACKGROUND OF THE INVENTION

It is a strong argument that the superior visual appearance of one commodity given the choice between competing brands—is the main factor influencing a consumer's final purchasing decision. Metallic coatings have historically been primarily paint based. Although, with chemical vapor deposition and similar technologies, metallic oxide coatings are finding several new functional and decorative applications. Such coatings can span a vast range of optical phenomenon: Metallic coatings exhibit luster. The coatings exhibit diaphaneity (i.e., they can be opaque or semi-transparent, or transparent). As such, the luster of the metallic coatings can be richly specular or present diffuse illumination from their reflective surfaces. They can display all manner of iridescence, including pearlescence and a more colorful nacreous look. Some metallic coatings exhibit goniochromism (dichromatic reflection) whereby a surface can display distinct color change depending on the angle of the viewer. Metallic coatings may also show temporal properties, such as glitter, glint, and aventurine brilliants. Such phenomena are related to the concept of binocular depth. Human visual perception can sense clarity in these films, as well as "binocular mottle." This term was coined by Calvin S. McCarny—it is the sense of texture resulting from the reflection of a subsurface through a translucent metallic surface-film.

Prior Art.

Metallic paints suffer from the drawback that they are not as specular as brightly polished or bright electroplated metals. Furthermore, there are inherent difficulties in obtaining paint uniformity over large surface areas in terms of color, thickness and luster. For multiple color applications, there is a need to purchase several different paints, or, if possible, mix new colorant pigments. Many consumer items which are fashioned from metal are painted because of the cost associated with electroplating and the desire to have colorful objects.

The marriage of clear lacquers with electroplated workpieces is used industrially to cover dissimilar metals, such as zinc die-castings and steel, in order to give the articles the same color tone and luster. In the prior art, it is known to take such work-pieces and apply finely divided bronze and copper metal powders, usually by spraying them on through a pneumatic spray jet in an admixture of lacquer. The painter then applies additional lacquer layers and polychrome dyes (known as polychroming) in order to achieve artistic results, such as an antique bronze finish. Once the article is painted, the underlying electroplated coating is partially visible, giving the article an increased specular metallic reflection. However, such work is tedious, labor intensive and involves both an artistic temperament and a technical understanding of the compatibilities of lacquer types and solvents, and there is the problem of color matching with the dyes.

The coloring of metals dates to ancient times. The discovery of Greek papyri manuscripts at Thebes in the early nineteenth century, believed to be from the sarcophagus of an ancient Egyptian alchemist, discusses, among other topics, the surface coloring of metals. [Lagercrantz, Otto. *Papyrus Graecus Holmiensis*, Upsula, Sweden: Akademiska, Bokhandeln, 1913]. There are a number of methods for depositing oxides on metal surfaces which imbue the metal substrate with light polarized interference colors. The discovery of this phenomenon is often attributed to the physicist Leopoldo Nobili (1784–1835), who conducted his experiments in 1826. He is credited with founding the art of metallochromy. However, the *Edinburgh Philosophical Journal* of 1823 discloses the inventions of Sir John Barton (1771–1834) on the production of "iris metal."

A metallochrome is defined as a coloring produced by light polarization of a deposited metallic compound. The authors do not wish to be bound by theory. It is believed, however, that the metallic film is to some degree translucent, allowing the transmittance of visible light through the film whereby some of the light is reflected at the film's exterior surface and whereby the remaining light is both partially adsorbed by opaque constituents within the semi-transparent film and reflected at the subsurface [substrate] layer causing the display of spectral colors by the optical interference of both surface and substrate reflections whose wavelengths correspond in hue to the thickness of the film. "Nobili's rings" are a rainbowy formation created by the irregular deposition of peroxide of lead from a bath of lead acetate. [David Fishlock. *Metal Colouring*, Teddington, England: R. Draper, 1962]. Nobili also succeeded in the deposition of cuprous oxide from a bath of copper acetate.

Other pioneers in the art of metallochromy were Fechner and later Elsner, who used zinc compositions. Boettger used a bath of copper and ammonium chloride. M. Puscher used lead acetate and sodium hyposulphite (c. 1869).

The noted physicist Antoine César Becquerel (1798–1878) also experimented with several elements and bath compositions. He is known as one of the founding fathers of the science of electrochemistry. He was the first to make the voltaic pile with constant current, thus ushering in the age of electrodeposition. His research included electroplating and electro-metallochromy.

After its introduction in 1845 at the German Industrial Exposition [Berlin], metallochromy found commercial application for use on toys and watch dials in factories in Nuremberg and Feurth, Bavaria. ["Metallochromy," *Manufacturer and Builder*, Volume 1, (7), July, 1969, p. 210].

There is little evidence that aqueous bath electroplated and immersion metallochrome coatings have been used in industry after that time. This may be due to the craft tradition of trade secrets. It is believed that the commercialization of metallochrome finishes fail due to the difficult nature of achieving consistent results. The principal drawback of metallochrome coatings is that they were not very durable for most applications. An article of metallochrome jewelry, for example, would wear within a short time period and lose its beauty. Certain metallochromes are subject to galvanic reduction by metals. The coatings are also subject to chemical reduction by acids and lacquer coatings with acidic pH levels and to thermal reduction. Applications for the coloring of more exotic metals by means of light interference will be briefly reviewed:

Certain valve metals may be anodized to produce a dialectric coating exhibiting interference colors, see A. F. Torrisi, "Relation of Color to Certain Characteristics of Anodic Tantalum Films, "*Journal of the Electrochemical Society*, April 1955, 102, (4), pp. 176–180. The reactive metals titanium and niobium may be anodized to produce polychromic effects and is largely used for jewelry applications. Also, anodizing techniques for coloring aluminum by means of light interference are known to the art.

The coloring of zinc is largely accomplished by chemical conversion coatings. In industry, steel is electroplated or hot dip galvanized with zinc, and in order to improve its corrosion resistance, a conversion coating with a chromate containing trivalent or hexavalent chromium, and often silver, is used. The photo-active silver in such conversion coatings has the disadvantage that exposure to ultraviolet light will discolor and diminish the luster. It is costly, in terms of waste processing, to treat for chromium and silver.

A light polarizing colored conversion coating on nickel is know to the art: Reference Keping and Fang in the reference citations above. Their coating uses cathodic passivation treatment of electroplated nickel by immersion in a molybdate phosphate solution.

The applicants are aware of a decorative coating which is similar in nature to the foregoing invention: Gorodetski, et al are the inventors of International Publication No. WO97/43127 (henceforth '127) "Articles Having a Colored Metallic Coating and Processes for Their Manufacture" (granted Nov. 20, 1997) assigned to Nickel Rainbow Ltd. (Yavne, Israel). This metallochrome coating is produced in a sulphide bath containing nickel, zinc, ammonium and thiocyanate ions when plated at current densities of 0.1 to 0.5 $A/dM^2$.

Blackening of Metals.

The artificial blackening of metals generally began by placing artifacts, such as cooking ware, over stove fires or coals. In the field of decorating metals, the artisan wanted to create an attractive aesthetic effect or to simulate the natural oxidation of antiquities. Puscher discovered that zinc could be blackened by boiling it in a solution containing sodium hyposulphite, lead acetate and copper sulphate.

As previously stated, the conversion coating of zinc is subject to decoloring due to the reaction of the silver component in conversion coatings. A black conversion coating of zinc can likewise be decolored, turning it to a gray or olive drab. This is undesirable.

Liver of sulfur (or sulfurated potash) is another commonly applied immersion for blackening copper, brass and silver. Incidentally, the process will also deposit spectral metallochromy films on substrates. The substance is a metastable compound of potassium polysulfides and sulfate which absorbs water and carbon dioxide from the air. It therefore has a short bath life rendering it unsuitable for industrial use.

Excellent processes in terms of specular reflectivity incorporate black rhodium and rhenium. There are also processes known in the art to create a blue finish on rhodium. There are no known aqueous cathodic processes for producing spectral interference colors using platinum group metals (PGM's). The primary disadvantage to coating applications using PGM's is their expense. This is only slightly mitigated by the fact that such depositions can be electroplated with relatively thin thicknesses. Please reference U.S. Pat. No. 4,416,742, "Process and Electrolytic Bath for Making a Rhodium-plated Article Having a Black or Blue Color," issued to Takashi, et al. See also Japanese patent 57174485, "Black Colored Rhodium Plating Solution" (10/1982) issued to Toshiyuki, et al.

Alternative technologies for the deposition of thin oxide films include sputtering, chemical vapor deposition, physical vapor deposition and ion beam deposition. These processes require comparatively expensive high technology equipment.

SUMMARY OF THE INVENTION

The invention comprises electrodeposition of nickel oxide and nickel-zinc oxide electrodeposited metallic thin film coatings. The bath electrolyte is composed of sodium lactate and chloride constituents. The metal ions are composed of zinc and nickel. A thiocyanate is also added to the bath. The coating comprises various spectral colors, depending on the length of electrodeposition time in a bath at a fixed temperature and electric current density. The article can be partially removed from the bath to create colorful aesthetic effects. The selective patterning of the part with a stop-off material will also create polychromatic effects. A durable final clear protective coating, such as acrylic lacquer, epoxy enamel, polyurethane, or a thermally cured powder coating, is applied for permanent decorative finishes.

The primary advantages of the present inventors' discovery vis a vis Gorodetski, et al., is that the alloy film bath which we have devised can operate in alkaline, neutral and acidic pH ranges. The fact that the bath can operate at an alkaline pH range makes it possible to deposit metallochrome films on a number of new substrates. Therefore, it is an object of the invention to provide a metallochromy alloy nickel bath which can be deposited on the so called difficult to plate substrates, such as aluminum, titanium, beryllium, leaded steels, stainless steels, etc. These substrates are noted for the fact that they deposit tenacious oxides quickly and therefore must be stripped of these oxides and pre-treated with more favorable metallic films, such as zincates.

Further, our invention will produce true black coatings, which is an embodiment specifically excluded in the '127 patent. The '127 patent also excludes white deposits. By modification of our bath to an alkaline pH level between 11 and 12, we have found that a whiteish translucent oxide of zinc can be electrodeposited on a substrate and that colorful metallochromy deposition ceases. A specific advantage of the high pH bath is that it offers an exceptional strike coating for the lower pH metallochromy embodiments in order to obtain color uniformity on large surface areas.

Another advance over the '127 patent is that by polarizing (or anodizing) an article which has been plated with the nickel alloy metallochromy film at 0.01–0.05 amps per sq. inch, and then subsequently re-plated to the identical coating, colors of greater depth and deepened richness and greater color consistency may be achieved.

Another advance over Gorodetski '127 is that there are three new methods to control the ability of the operator to match a color sample. These methods are: polarization (oxidation), reverse plating (which both strips and oxidizes the film), and reduction (which lightens or color-alters the film).

First, by reverse plating an article's color may be changed. The intensity of the article may also be darkened by polarizing an article at 0.01 to 0.05 amps per square inch. The colored interference film of our invention can the be plated over the now color-altered or darkened coating. There are two ways of accomplishing this oxidation. One method is to use in situ power interruption. In this case, the bath will become a battery on its own in reaction to the article (which may have been energized by the prior plating). Thus, the coating on the part may partially strip and will most likely be darkened (especially in the case of greater film thicknesses).

Second, the part may be reverse plated electrolytically by switching the electrodes (i.e., making the part anodic) and proceeding at the same current density. This method will deplate the colors in spectral sequence, and the colors will be of slightly different appearance than the corresponding colors of the cathodically deposited color sequence. This method offers the most dramatic differences and may be useful for colored parts which have had a stop-off pattern applied to them.

Third, the part may be reduced electrolytically using a caustic pH or neutral bath of sodium or potassium hydroxide, carbonate or lactate. Another method to accomplish this is advantageous for the practitioner. An existing electrolytic mild caustic electroplating cleaner may be used without changing the polarity of the electrodes. The part is reduced at 4 to 6 volts D.C. using "direct hook-up," i.e., the part is cathodic. At this voltage, the colored coating will also lighten or become color-altered. This change in color tone will be more noticeable if reduced in a hot solution.

A supremely important embodiment from a commercial perspective is the discovery that by interrupting the current for a period of 20 seconds to 2:00 minutes and then resuming electrolytic deposition, the article can, for unknown reasons, actually achieve a desired color in less time than if the power interruption method had not been used. Other modifications, such as pulse plating and reverse pulse plating, are obvious equivalents.

It is important from a commercial vantage to be able to coat mass produced articles of consistent color. Therefore, it is necessary to match a color sample. We have discovered techniques to improve the ability of the operator to match colored coating.

OBJECTS OF THE INVENTION

A primary object of the invention is to provide for the coloring of articles for both decorative and functional purposes by means of utilizing light polarizing thin films of nickel and nickel alloy oxides on electroplated or mechanically surface finished articles whereby the undercoating may be Ti, Co, Ni, Cu, and such alloys as stainless steels, brasses and bronzes, steel, etc.

An object of the invention is to provide a color electroplated coating and process therefor which is capable of producing, and reproducing with exactitude, the deposition of various colors and hues through the utilization of light polarizing nickel oxide or nickel-zinc oxide electrodeposition baths without altering the chemical composition of the electrolyte in order to achieve said colors.

A further object of the invention is to provide a glass-like or vitreous appearance to the colored metallic thin-film and to provide a sense of binocular depth to the observer of the color plated article. An accompanying object of the invention is to provide a thin film colored coating with superior adhesion characteristics.

A still further object of the invention is to provide a thin film colored coating which is resistant to degradation by ultraviolet light.

It is a desired object of the invention to provide a coating which can be deposited on metallized plastics (e.g., polyvinyl chloride), electroconductive glasses and ceramics, as well as electroconductive metallic seed layers.

Another object of the invention is to deposit such light polarizing thin films on electroconductive transparent substrates, such as glass, glass fibers, including an indium tin oxide (ITO), coated polyester, such as polyethylene terephthalate, or a conductive transparent substrate, such as polyaniline (emeraldine).

It is an object of the invention to deposit colorful films of thin films of nickel and nickel alloy oxides on electroconductive ceramics.

Still another object of the invention is to provide an environmentally friendly electrodeposition process for depositing such colored coatings.

An object of the invention is to provide a bath electrolyte which is free of noxious odors and related occupational safety and health concerns.

Yet a further object of the invention is to provide a colored overlay for zinc electroplated articles and, by using neutral or high pH embodiments of the bath, producing a color film coating to be deposited directly over raw zinc and aluminum die castings.

An object of the invention is to provide a bath process for the controlled electrodeposition of metallochromy nickel zinc oxides on an article by altering the means of deposition, e.g., direct current, reverse current, altering the current density and using in situ oxidation by selective current interruption.

A further object of the invention is to provide a thin-film colored coating which is transparent at a certain range of thicknesses and which resembles allochromatic or opaque colors at greater thicknesses.

A further object of the invention is to provide a thin-film colored coating which is resistant to reduction or degradation at high temperatures.

Other objects of the invention will become apparent through disclosure in the specification hereinbelow.

DETAILED DESCRIPTION OF THE INVENTION

Electro-chemists skilled in the art know that high alkaline nickel plating solutions become thixotropic—the condition of a gelled solution becoming fluid upon being shaken or stirred and then upon return to a static condition, returning to a semi-solid gel. Nickel will often precipitate out of solution when the pH level is raised to alkaline levels. These are frustrating conditions that would thwart one's inventive pursuit to develop an alkaline pH electroplating bath. The present invention has overcome these difficulties by producing stable high pH nickel alloy baths. The high chloride bath hereinbelow is the first preferred embodiment.

EXAMPLE 1

High Concentration Embodiment:

The bath is comprised of two major constituents:

- First constituent:
  - 400 mL/l sodium lactate, 30° Baumé, 11.6 pH
- Second constituent:
  - 24 g/l nickel chloride, nickel ammonium sulfate, nickel sulfate, nickel lactate, or nickel thiocyanate
  - (optional)* 0–100 g/l sodium chloride, ammonium chloride, calcium chloride, or potassium chloride
  - (optional) 0–2.4 g/l zinc chloride (optional), zinc ammonium chloride, zinc oxide, zinc lactate, or zinc thiocyanate
  - 30 g/l sodium thiocyanate, ammonium thiocyanate, or potassium thiocyanate

*The bath will perform better if at least one optional element is used, otherwise metallochromy deposition may cease.

At a temperature of 27° C. with a current density of 0.0078 to 0.02 amps per square inch, the electrodeposit on the substrate will initially create a brass, golden, reddish bronze, burgundy, violet, purple, dark blue, powder blue, pale yellow, and green. Altering the current density in the early stages of the sequence will affect the tints of the color sequence. The current density may be substantially increased after the coating thickens. This will permit the plating rate to likewise increase, however the parts may be slightly darker than they would otherwise be if the current were left at a constant rate. An increase in current density once the coating has gotten thicker will permit the coating to turn black. If the current density is left constant, the spectral series then repeats itself several times so that in order to obtain a final black color within an economical time period, the current must be increased. In general, the repeated colors may be more vivid, of varying intensity or of altered tint. However, alteration of current will determine the intensity of the deposited coating. The operator may at any time remove them from the bath in order to select the color desired. In this example and the next, current amperage is 0.03 amps per square foot. Additionally, the coating can be slowly stripped in situ by interrupting current supply, which is useful for obtaining color matches to the master sample. One can also reverse the electrodes in order to proceed by electrolytic stripping in situ.

Mechanical cathode agitation, ultrasonic agitation, air agitation, or a combination thereof, are desirable in order to help obtain uniform deposits and to avoid the zinciferous "tiger stripping" (or striations) caused by plating at high current densities in a static bath. A static bath, however, may be used intentionally to produce striations for decorative effects. The positioning of the cathodic article in the tank will determine the lateral direction of the striations because the tiger stripe is caused by escaping gasses which form across the article during deposition.

A plating temperature 27° C. is recommended. The amperage may be optionally restricted at 0.0078 amps per sq. in. during the plating cycle (i.e., amperage is set in conjunction with voltage setting so that an increased load will not make amperage increase—this will permit D.C. voltage to increase automatically during the plating cycle as the electrodeposit thickens). We prefer carbon anodes, however stainless steel anodes or nickel anodes may be used. The colors obtained as a surface finish depend upon several parameters. The more important parameters are bath temperature, amperage per unit area and time of deposition.

Low Concentration Embodiment:

The bath is comprised of two major constituents:

First constituent:

200–500 ml/l sodium lactate, 30° Baumé, 11.6 pH

Second constituent:

6.0 g/l nickel chloride, nickel ammonium sulfate, nickel sulfate, nickel lactate, or nickel thiocyanate (optional) 0–400 g/l sodium chloride (optional), ammonium chloride, calcium chloride, or potassium chloride (optional) 0–20 g/l zinc ammonium chloride, zinc oxide, zinc lactate, or zinc thiocyanate 10 g/l sodium thiocyanate A color plated metal tube of the second embodiment was powder coated at a temperature of 500° F. The visual appearance of the coating was unaffected by the temperature.

The colors obtained as a surface finish depend upon several parameters. The more important parameters are bath temperature, amperage per unit area and time of deposition. For example, in a 16° C. bath temperature, a pale brass color first appears and gradually approaches bronze after a period of about five minutes.

We had coated parts of our invention from the bath of the first embodiment analyzed at the Aldoa Company (Detroit, Mich.) by a Veeco XRF 4200 non-contact, non-destructive Micro X-Ray Fluorescence tool manufactured by Veeco Instruments, Corporate Headquarters and Process Equipment, Plainview, N.Y. The thickness of a black colored part was 0.4 mills (10 microns). The content of nickel was 87% and 13% zinc. The thickness of a blue colored part was 0.3 mills (7.6 microns). The content of nickel was 75% and 25% zinc.

The Patterning of Designs Through Resist Techniques.

Resists are known in the art of electroplating. There are a number of stop-off materials: mucilaginous gums (such as gum tragacanth, gum arabic, gum mastic), the silkscreening of lacquers, the use of hot melt waxes, natural waxes (such as beeswax, Japan wax, Montan and Carnuba), as well as petroleum waxes (such as parafin and microcrystalline waxes—either acid or alkali stable, depending on the nature of the emulsifying agent), and photoresists, including the use of rapid prototyping technologies which employ the use of such a resist. For example, International Publication No. WOOO/53398 discloses the use of a stereolithographic laser beam curing system to create holographic patterns which may be used to create patterned electrodeposits.

In the 19th century, electrotypers used an artistic method called "parcel plating" or "parceling" to create colored designs on metals which were created by applying stop-offs. There are few examples of other colored metal patterning techniques in the prior art. There are examples of blackened antiques which have resist patterns. The hand coloring Daguerreotype with silver and paint was explored. One historic exception stands out. The Japanese artisan Denbei Shoami (1651–1728), an armoror for a feudal lord, invented the art of Mokume-Gane (wood grained metal). Different colored metals were bonded together thermally or by pressure (such as gold beating or repousse) in order to cause inter-metallic diffusion of sandwich layers. Some surface coatings were used to darken the metals. For example, ground "Daiken" (an indigenous radish) was made into a solution whereby silver metal could be blackened. By engraving the metal and using other techniques, the underlying colors were exposed. [Hiroko Sato Pijanowski and Gene Pijanowski. "Wood Grained Metal: Mokume-Gane," http://www.silversmithing.com/lmokume.htm, Society of American Silversmiths, accessed May 9, 2001].

The metallochrome finishes we have invented can produce artificial wood grains, metallic marbelized finishes, and other patterned finishes through the use of stop-off coatings in conjunction with any combination of re-plating in the bath and selective stripping with a number of stripping solutions. The use of stamped or embossed textured metals, such as those commercially available from Rimex Metals (Edison, N.J.), can be employed on fabricated items to increase the perception of binocular mottle because of the contrasts of the subsurface reflection.

We used a substantially diluted proprietary etch salt called Aldac™ which contains sodium bisulfate and sodium fluoride sold commercially by the Aldoa Company (Detroit, Mich.). Also, the stripping solutions "back-off" the colors in reverse order of deposition so that by immersing the article for a set time period in the strip the colors will strip down to the next hue in spectral order. The process is remarkably good because it strips the colors with uniformity of thickness so that unwanted polychromatic splotchiness does not occur. Furthermore, a very diluted acid, such as hydrochloric or fluoboric, may be used to selectively strip the metallochromy finish via immersion but have the undesirable property of liberating the sulfur presumed to be liberated from the thiol compound-sodium thiocyanate. These fumes are also presumed to be noxious and unsuitable for modem electroplating practice. It has also been discovered that the coatings of our invention may be stripped-off entirely or selectively with resist techniques through electrolytic action with a steel anode, stainless steel, nickel anode or insoluble anode, such as carbon, without damaging the underlying nickel plated substrate.

Metallic wood grains can have grains which exhibit diffuse illumination and grains which are richly specular in contrasting colors. This is accomplished by applying a stop-off over a brightly color plated surface and then depositing a frosty (cloudy) partially "burnt" pattern by raising the current density. For example, a wood grain pattern can be made to have a black outline of specular bronze colored grains with contrasting frosty burgundy colored grains—the frosted effect being achieved by plating at elevated level from normal current density. Of course, other modifications of the process will be obvious to those skilled in the art.

Marbelized metallic finishes which simulate the appearance of natural color marbles may be created by randomly frosting the article in portions by increasing current density so that it partially "burns" the article being plated. (A burn is generally known in the art as an uneven layer caused by the deposition on a high current density area.) This burn may be accomplished in situ using either the high or low concentration embodiments of the bath, or a frosted burn effect, only, may be accomplished by using the earlier disclosed strike bath having a pH level of 11 to 12. This frosted coating is subsequently re-colored by a metallochromy bath embodiment. The frostiness of the burnt layer is characterized by a diffusely illuminated coating which is flat or matte in appearance and by a whitening or blushing of the deposit.

Transparent Protective Superstrate Films and Guard Coatings.

Clear varnishes, shellacs, acrylic lacquers, polyurethanes, enamels, and powder coatings exemplify coatings which may be applied to the zinc-nickel color finish in order to help preserve it. It has been determined by the present authors that acidic pH properties of the clear coatings in general have deleterious effects on metallochromy finishes. In order to correct this deficiency, a slaked lime or gypsum may be added to the clear resinous coating and subsequently filtered out in order to adjust the pH of the lacquer composition.

Some clear protective coatings offer superior performance. Powder coating, for example, is extremely hard and wearable. Polyvinyl fluoride film, sold by Dupont under the tradename Tedlar®, has excellent resistance to chemicals, solvents and staining. Other polymers having significant durability are clear epoxy finishes, such as the tradenames Polane® and Emeron®, sold by Sherwin Williams and Dupont, respectively. Polytetrafluoroethylene, trifluorochloroethylene are also examples of modem coatings which offer superior wearability, water-repellancy, transparency and weather resistance. The existence of modem coatings permits the use of our invention for indoor and outdoor architectural finishes which would otherwise oxidize or wear with exposure to acid-rain, air-pollutants, abrasive cleaning agents, etc. For example, many highly prized colors are obtainable. Vitreous lusters of bronze and gold may be applied, as well as a range of highly metallic and exceptionally vivid colors.

In the prior art section, we noted the use of polychroming techniques for coloring metals with lacquers. Our invention can eliminate or simplify this process. Dyes can be eliminated, as well as the need for polychroming with multiple lacquer layers in order to achieve a desired result. Our invention discloses ways of modifying the luster by creating a hoarfrost appearance on the plated article by increasing current density. However, by spraying matte and semi-gloss lacquers upon normal nickel zinc oxide metallochrome deposits which are vitreous and specular, the luster will be diminished; however, the specular reflectivity of the metallochrome underneath the lacquer is supreme. Therefore, our process offers a new range of optical properties for architectural coatings and manufactured products.

In the case of architectural coatings and metals conservancy, it is often desired to recreate antique coatings which have been destroyed by corrosion or fire damage. It is known in the art to apply carbon black with a small proportion of admixed bronze powders in the lacquer in order to create a faux antique look. Black dyes may also be used. Such a method can complement our process in achieving simulated bronze antiques while certain colors in the spectral sequence of the coating deposition can simulate antique appearance without the need for such surface treatments. These processes are environmentally friendly compared with 19th century processes, such as Paul Malherbe's introduction cupric selenite for blackening metals and the extensive use of amalgams for gold finishes.

Surface Finishing.

The semi-transparent metallochrome coating we have invented can be complemented by various surface treatments which create texture on the substrate and give the perception of binocular mottle once deposited. Such treatments include burnishing, etching, sandblasting and other media-blasting, vibratory tumbling, sanding, brushing, satin wheel buffing, etc.

Another color modifying technique is to use reduction in caustic soda or sodium carbonate solutions at a temperature range of 40° F. to 130° F. The current density is of about 1 amp per sq. meter. Inexpensive steel anodes may be used for this process.

What is claimed is:

1. A method of producing various spectral colors, including black, on a cathodic substrate comprising electrodepositing on the cathodic substrate both nickel oxide and zinc oxide by immersion in a bath comprised of a first constituent selected from the group consisting of sodium lactate in water and potassium lactate in water;

a second constituent selected from the group consisting of nickel ammonium sulfate, nickel sulfate, nickel chloride, nickel lactate and nickel thiocyanate;

a third constituent selected from the group consisting of ammonium chloride sodium chloride, calcium chloride, and potassium chloride;

a fourth constituent selected from the group consisting of zinc ammonium chloride, zinc oxide, zinc lactate, zinc chloride and zinc thiocyanate;

a fifth constituent selected from the group consisting of sodium thiocyanate, ammonium thiocyanate and potassium thiocyanate; and further comprising the step of immersing the substrate in a dilute aqueous solution containing between 4 and 10 g/l of ammonium bifluoride or ammonium fluoride subsequent to application of a plating layer by the bath to obtain multi-colored designs on the substrate.

2. The method of claim 1 further comprising the step of applying a current in the range of 0.0078 to 0.03 amps per square inch.

3. The method of claim 1 further comprising the step of in situ interruption of the current to strip and oxidize an electrodeposited color coating on the substrate.

4. A method of producing various spectral colors, including black, on a cathodic substrate comprising electrodepositing on the cathodic substrate both nickel oxide and zinc oxide by immersion in a bath comprised of a first constituent selected from the group consisting of sodium lactate in water and potassium lactate in water;

a second constituent selected from the group consisting of nickel ammonium sulfate, nickel sulfate, nickel chloride, nickel lactate and nickel thiocyanate;

a third constituent selected from the group consisting of ammonium chloride, sodium chloride, calcium chloride and potassium chloride;

a forth constituent selected from the group consisting of zinc ammonium chloride, zinc oxide, zinc-lactate, zinc chloride and zinc thiocyanate;

a fifth constituent selected from the group consisting of sodium thiocyanate, ammonium thiocyanate and potassium thiocyanate; and further comprising the step of immersing the substrate in a dilute aqueous solution containing between 4 and 10 g/l of sodium fluoride subsequent to application of a plating layer by the bath to obtain multi-colored designs on the substrate.

5. The method of claim 4 further comprising the step of applying a current in the range of 0.0078 to 0.03 amps per square inch.

6. The method of claim 4 further comprising the step of in situ interruption of the current to strip and oxidize an electrodeposited color coating on the substrate.

* * * * *